US006273746B1

(12) United States Patent
Seko et al.

(10) Patent No.: US 6,273,746 B1
(45) Date of Patent: Aug. 14, 2001

(54) CONNECTOR AND A METHOD FOR PRODUCING THE SAME

(75) Inventors: Satomi Seko; Masamitsu Chishima, both of Yokkalchi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/406,466

(22) Filed: Sep. 27, 1999

(30) Foreign Application Priority Data

Sep. 28, 1998 (JP) ..... 10-273115

(51) Int. Cl.[7] ..... H01R 11/20
(52) U.S. Cl. ..... 439/417; 439/397
(58) Field of Search ..... 439/417, 397, 439/404, 498, 188

(56) References Cited

U.S. PATENT DOCUMENTS

| | | | | |
|---|---|---|---|---|
| 5,041,009 | * | 8/1991 | McCleerey | 439/405 |
| 5,178,558 | * | 1/1993 | Knox et al. | 439/404 |
| 5,433,625 | | 7/1995 | Tsuji et al. . | |
| 5,690,505 | * | 11/1997 | Hirata | 439/402 |
| 5,713,756 | * | 2/1998 | Abe | 439/404 |
| 5,769,650 | * | 6/1998 | Aoyama et al. | 439/189 |
| 5,833,486 | * | 11/1998 | Shinozaki | 439/404 |

FOREIGN PATENT DOCUMENTS

| | | |
|---|---|---|
| 90 00 483 U | 5/1991 | (DE) . |
| 0 802 581 | 4/1997 | (EP) . |
| 0 810 698 A2 | 12/1997 | (EP) . |
| 9-27356 | 1/1997 | (JP) . |

* cited by examiner

*Primary Examiner*—Gary F. Paumen
*Assistant Examiner*—Ross Gushi
(74) *Attorney, Agent, or Firm*—Anthony J. Casella; Gerald E. Hespos

(57) ABSTRACT

A connector is provided to avoid problems in producing and handling a wiring harness when one conductive path which is branched from a main path of the wiring harness and returns thereto again after passing via branch paths is constructed. To achieve this objective, a cutter 25 is provided between two blade-type terminal fittings 20*a*, 20*d* of a joint connector 10, and a main wire Waa is connected with the two blade-type terminal fittings and cut therebetween by the cutter 25. By connecting a branching connector 40 with the joint connector 10, branch terminal fittings 41*a*, 41*d* are connected with the blade-type terminal fittings 20*a*, 20*d*. Since all main wires forming a wiring harness WH are allowed to have the same length and to be bundled together, there is no problem in producing and handling the wiring harness WH.

4 Claims, 8 Drawing Sheets

CONNECTOR AND A METHOD FOR PRODUCING THE SAME

BACKGROUND OF THE INVENTION

1. Field of the Invention

The present invention relates to a connector and a method for producing the same.

2. Description of the Prior Art

A prior art automotive wiring harness, as shown in FIG. 14, has a plurality of main wires "a". A plurality of branch wires "b" are branched from intermediate positions of the main wires "a" and extend to a variety of electric or electronic devices. The branch wires "b" are connected with blade-type terminal fittings "d" of a joint connector "c" and also connected with crimping terminal fittings "f" of a branching connector "e". Both terminal fittings "d" and "f" are connected by connecting the two connectors "c" and "e".

In the prior art branching construction of FIG. 14, one branch wire "b" is branched from one main wire "a". In recent years, there has been a demand for a mode of wire arrangement different from the prior art construction of FIG. 14. The demanded mode is shown in FIG. 15 and has an arrangement path of a main wire "g" cut. Two branch wires "h" are extended from this cut portion and are connected with an equipment "j". The two branch wires "h" are not simply branched from the one main wire "g" in this prior art arrangement. Rather, one conductive path extends from one part of the cut main wire "g" to the outward branch wire "h" and returns to the other of the cut main wire "g" via the equipment "j" and the return branch wire "h".

The prior art method for branching one branch wire "b" from one main wire "a", as shown in FIG. 14 cannot be employed for the prior arrangement of FIG. 15. However, it may be considered efficient to produce the prior art arrangement of FIG. 15 by making the wire "g" longer than other main wires "k". Thus a lengthened portion may be used as the branch wires "h" that then are branched from the main path and extended to the equipment "j". However, according to this possible method, the lengthened portion "h" sticks out from a bundle of a plurality of main wires "g", "k" forming the wiring harness. This complicates a process of producing the wiring harness and causes a problem that the wire "h" sticking out of the wire bundle gets caught while the wiring harness is handled.

The present invention was developed in view of the above problem and an object thereof is to avoid problems in producing and handling a wiring harness when one conductive path which is branched from a main path of the wiring harness and in particular returns thereto again after passing via branch paths is constructed.

SUMMARY OF THE INVENTION

According to the invention there is provided a connector for branching at least two branch wires from a cut position of a main wire of a wiring harness. The connector enables construction of one electrically conductive path which extends from one part of the cut main wire and which returns to the other part of the cut main wire via the branch wires. The connector comprising: a joint connector. At least two blade-type terminal fittings are provided in the joint connector for connection with the main wire. A cutter preferably is provided substantially between the two blade-type terminal fittings in the joint connector for cutting the main wire. A branching connector is provided for connection with the joint connector, and two branch terminal fittings are provided in the branching connector. The branch terminal fittings are secured to the branch wires and are connectable with the blade-type terminal fittings.

The main wire is cut between the two blade-type terminal fittings of the cutter when being connected with the two blade-type terminal fittings of the joint connector. As a result the blade-type terminal fittings are connected with the cut ends of the main wire. The branch terminal fittings are connected with the blade-type terminal fittings when the branching connector is connected with the joint connector in such a state. Thus the two branch wires are branched from the cut position of the main wire of the wiring harness to construct one electrically conductive path which extends from the one part of the cut main wire and returns to the other part of the cut main body via the respective branch wires.

The main wires that form the wiring harness are allowed to have the same length before the connector according to the invention is connected with the wiring harness, and can be bundled together regardless of whether they are to be branched or not. Therefore, there is no problem producing and handling the wiring harness.

According to a preferred embodiment of the invention, there also is provided a guide portion in the vicinity of the cutter for displacing cut ends of the main wire cut by the cutter in directions substantially away from each other. The guide portion prevents the cut ends from being shorted.

Preferably, a dummy member is provided with a shorting terminal fitting for shorting the two blade-type terminal fittings. The dummy member is at least partly fittable into a connecting portion of the joint connector into which the branching connector is at least partly fittable.

The two blade-type terminal fittings can be shorted by the shorting terminal fitting until the joint connector is connected with the branching connecter after the main wire is assembled with the joint connector. Accordingly, it is possible to prevent a potential difference between the two blade-type terminal fittings when the branching connector is not connected.

The joint connector may comprise a connector cover having one or more pressing portions in positions that correspond to respective terminal fitting(s) for connecting the corresponding wire(s) with the terminal fittings. Accordingly, the wire(s) can be fitted securely into the respective terminal fitting(s).

According to the invention, there further is provided a method for producing a connector for branching at least two branch wires from a cut position of a main wire of a wiring harness to construct one electrically conductive path which extends from one part of the cut main wire and returns to the other part of the cut main wire via the branch wires. The connector comprises a joint connector having at least two blade-type terminal fittings and a branching connector for connecting the two branch wires with the two blade-type terminal fittings. The method comprises the steps of placing the main wire over the two blade-type terminal fittings, cutting the main wire between the two blade-type terminal fittings and connecting the main wire with the two blade-type terminal fittings.

In producing the connector, the main wire is cut between the two blade-type terminal fittings while being placed over them. Then, the branching connector is connected with the joint connector. As a result, the two branch wires are branched from the cut position of the main wire, thereby preferably constructing one electrically conductive path which extends from the one part of the cut main wire and returns to the other part of the cut main body via the one and the other of the branch wires.

According to this inventive method, before the connector according to the invention is connected with the wiring harness, the main wires that form the wiring harness are allowed to have the same length and can be bundled together regardless of whether they are to be branched or not. Therefore, there is no problem in producing and handling the wiring harness.

According to a preferred embodiment of the invention, the step of connecting the cut ends of the main wire with the two blade-type fittings is performed after the step of cutting the main wire.

Preferably, the cutting step comprises the step of pushing the main wire onto a cutter that is provided between the two blade-type fittings in the joint connector.

Further preferably, a cutter is provided between the two blade-type terminal fittings in the joint connector and, after the main wire is cut by the cutter, the cut ends of the main wire are connected with the two blade-type terminal fittings.

When being cut, the main wire unavoidably is deformed and curved due to a resistance from the cutter. As a result, the opposite ends of the curved portion are pulled along the longitudinal direction of the main wire while the main wire is being cut, and are returned in opposite directions along the longitudinal direction upon being released from the pulling force after the cutting. In this invention, however, the main wire is connected with the blade-type terminal fittings at the opposite sides of the cut portion after being cut. Accordingly, there is no likelihood that the main wire moves back and forth along its longitudinal direction in the connected positions as in a case where it is cut after being connected with the terminal fittings. Therefore, contact stability in the connected positions can be secured.

Still further preferably, the method further comprises the step of bendingly deforming the two cut ends of the main wire by means of a guide portion of the joint connector to separate them from each other.

Most preferably, the method comprises the step of providing a dummy member that has a shorting terminal fitting. The method then includes a step of at least partly fitting the dummy member into a connecting portion of the joint connector into which the branching connector is at least partly fittable for shorting the two blade-type fittings.

These and other objects, features and advantages of the present invention will become more apparent upon a reading of the following detailed description and accompanying drawings.

DETAILED DESCRIPTION OF THE PREFERRED EMBODIMENT

Figure 1:
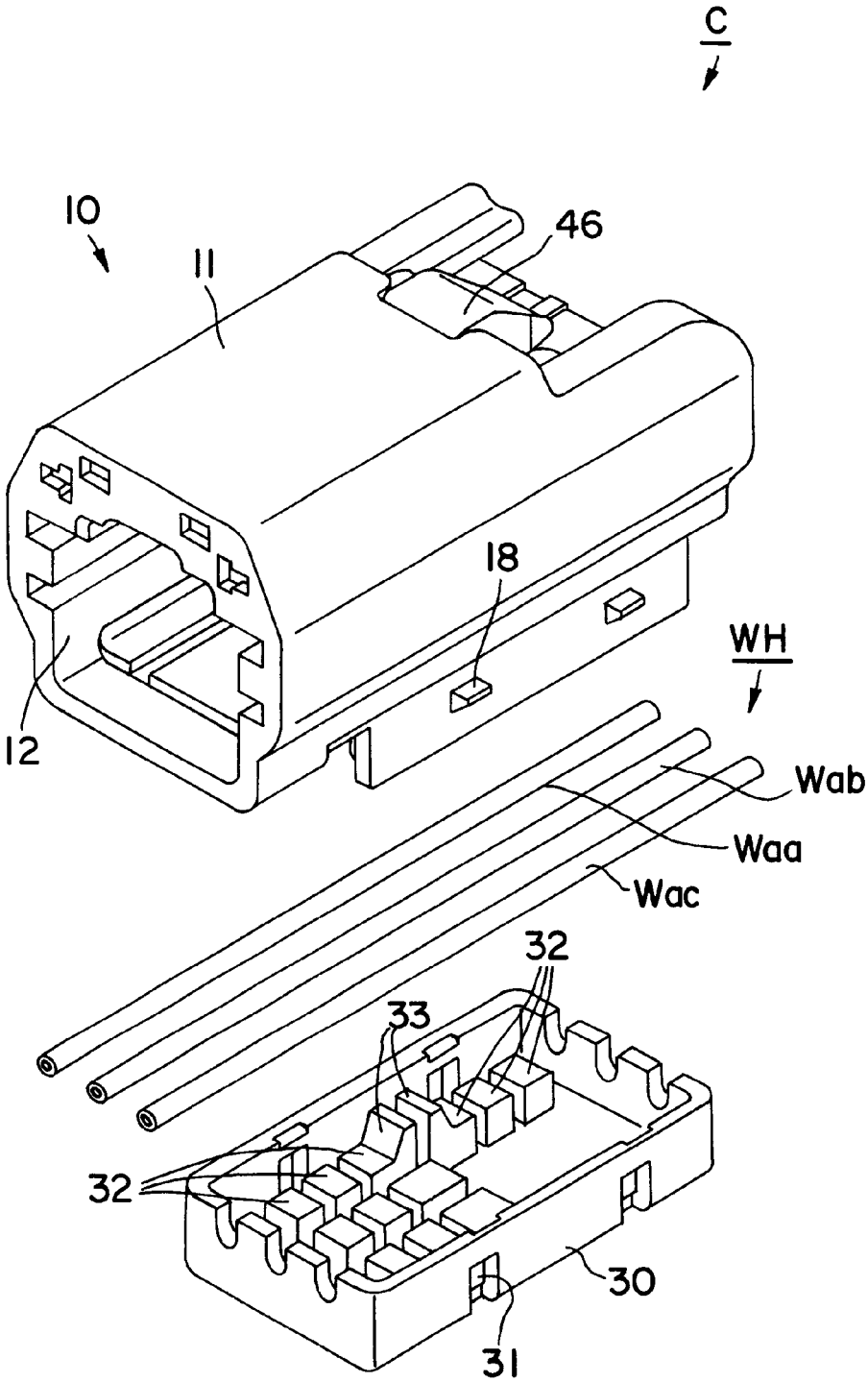
FIG. 1 is an exploded perspective view of a joint connector according to a first embodiment.
Figure 2:
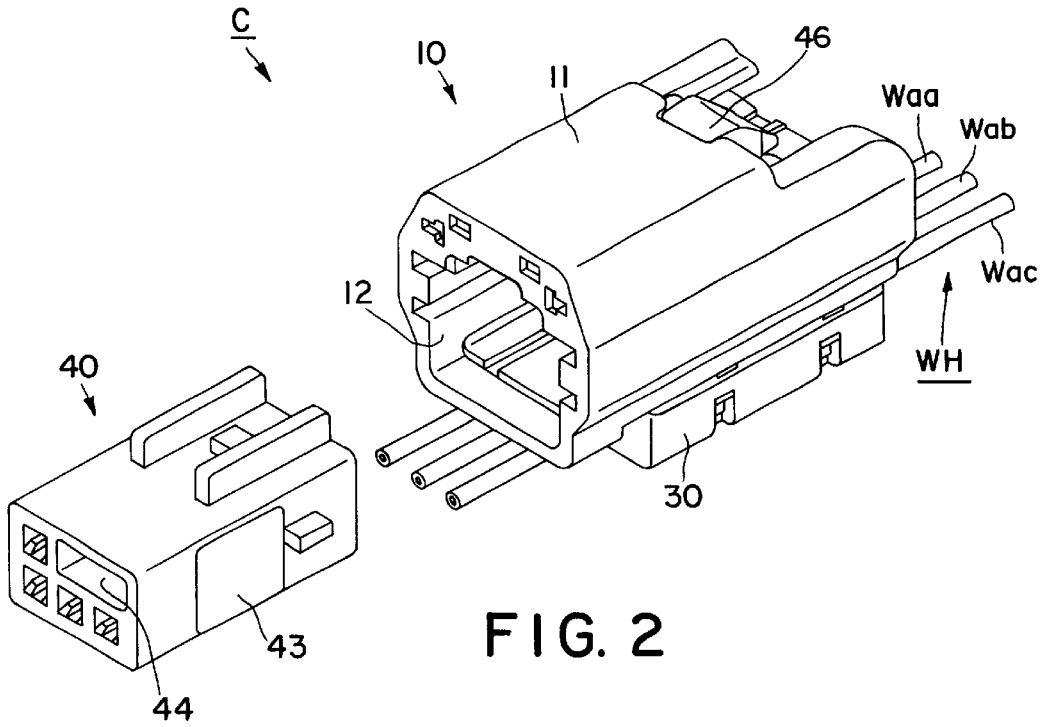
FIG. 2 is a perspective view of a connector before the joint connector and a branching connector are connected.
Figure 3:
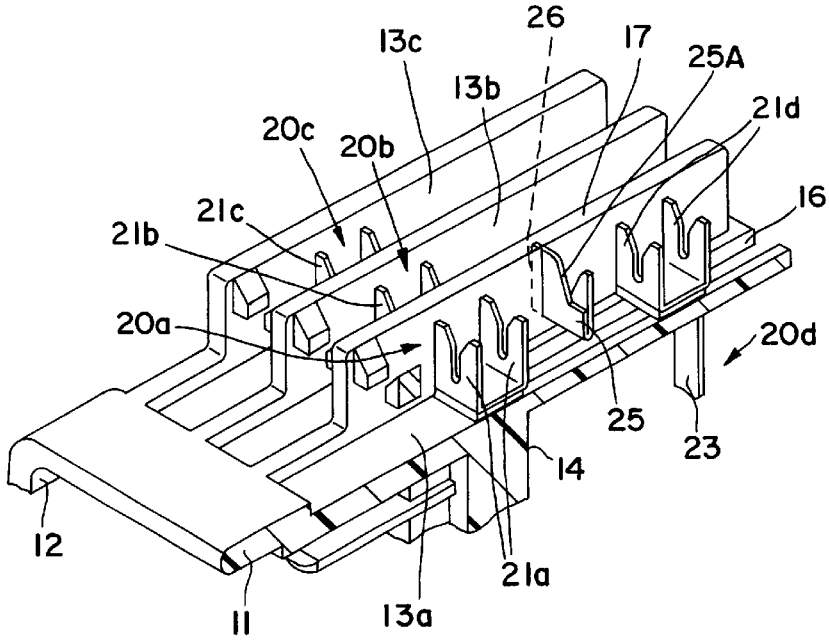
FIG. 3 is a partial enlarged perspective view showing blade-type terminal fittings and a cutter with the joint connector turned upside down.
Figure 4:
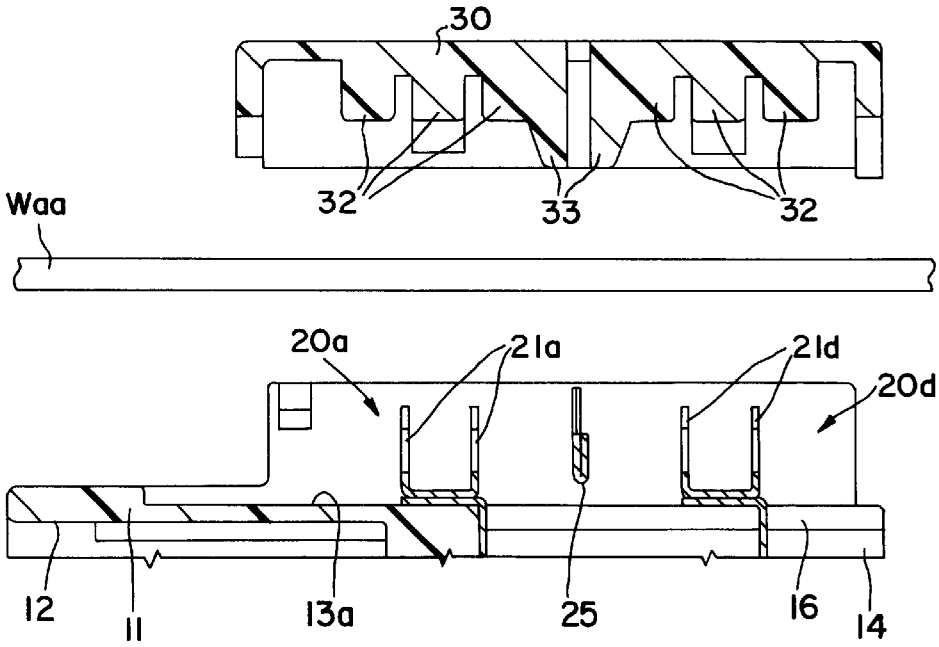
FIG. 4 is a partial enlarged section showing the positional relationship of the blade-type terminal fittings, the cutter, a main wire and a wire cover with the joint connector turned upside down.
Figure 5:
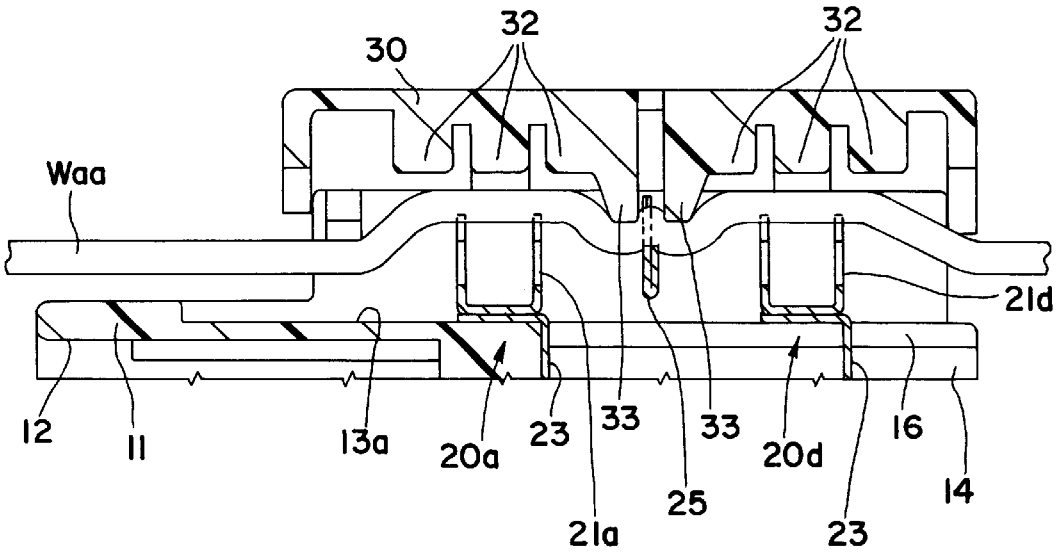
FIG. 5 is a partial enlarged section showing how the main wire is cut with the joint connector turned upside down.
Figure 6:
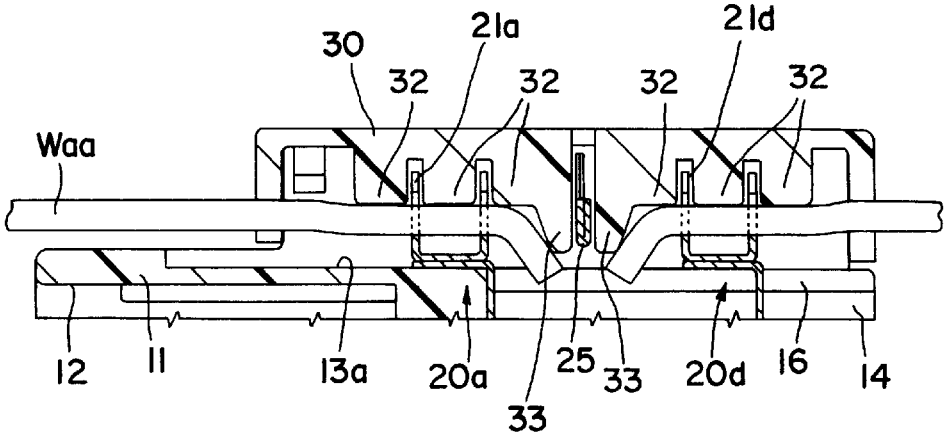
FIG. 6 is a partial enlarged section showing the main wire having its insulation coating cut for an electrical connection with the joint connector turned upside down.
Figure 7:
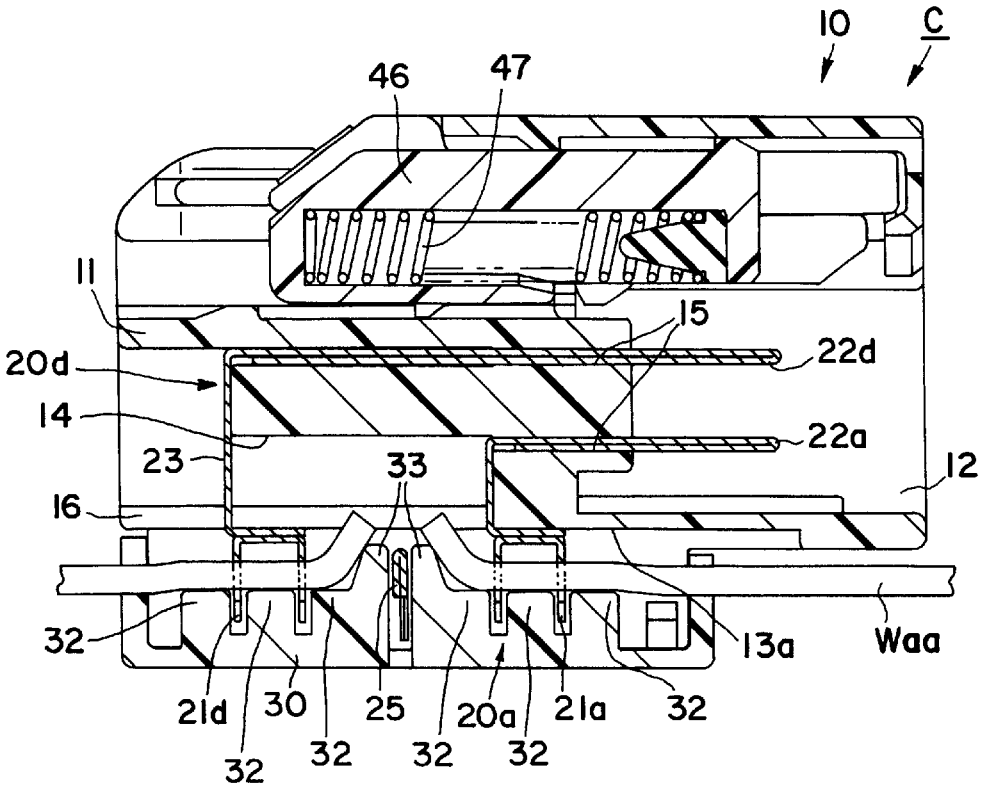
FIG. 7 is a section showing the main wire cut and connected with the blade-type terminal fittings.
Figure 8:
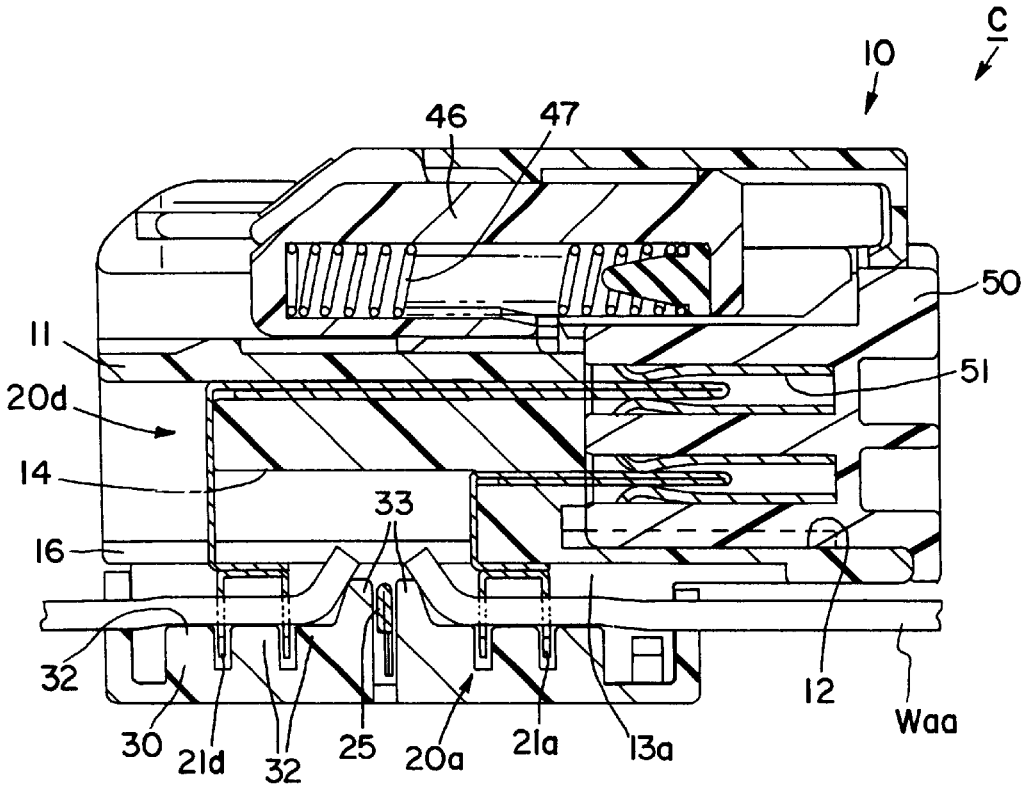
FIG. 8 is a section showing a state where a dummy member is fitted into the joint connector.
Figure 9:
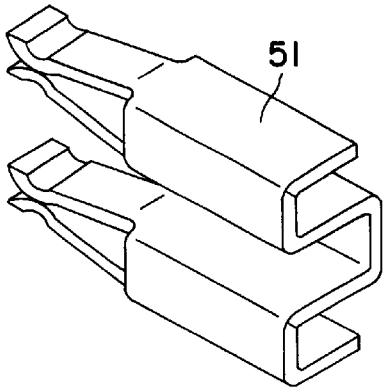
FIG. 9 is a perspective view of a shorting terminal fitting of the dummy member.

A connector according to the invention is identified by the letter C in FIGS. 1 to 13. The connector C is employed with a wiring harness WH that has first to third main wires Waa, Wab and Wac. The first main wire Waa of the wiring harness WH is cut or interrupted in an intermediate position, and ends of first and fourth branch wires Wba and Wbd are connected with the respective cut ends of the first main wire Waa. These two branch wires Wba and Wbd are connected with an equipment M provided in an automotive vehicle. The remaining second and third main wires Wab and Wac are connected with second and third branch wires Wbb and Wbc by the connector C.

The connector C is comprised of a joint connector 10 and a branching connector 40. The joint connector 10 is provided with a connector housing 11 and a wire cover 30. The connector housing 11 is formed with an opening, preferably a forward opening, which defines a connecting portion 12 into which the branching connector 40 is at least partly fittable. First to third wire arrangement grooves 13*a*, 13*b* and 13*c* are formed below the connecting portion 12 and are open in the lower surface of the connector housing 11. The first to third wire arrangement grooves 13*a*, 13*b* and 13*c* are substantially side-by-side and extend substantially along forward and backward directions. Portions of the first to third wires Waa, Wab and Wac are accommodated in the corresponding first to third wire arrangement grooves 13*a*, 13*b*, 13*c*. The connector housing 11 also is formed with a terminal fitting mounting space 14 which is open, preferably backwardly, and is shorter in its upper stage and longer in its lower stage. Three slit-shaped press holes 15 are formed substantially side by side in the back end surface of the longer lower stage of the mounting space 14 and communicate with the connecting portion 12. On the other hand, one press hole 15 is formed in the back end surface of the shorter upper stage of the mounting space 14 and communicates with the connecting portion 12. Blade-type terminal fittings 20*a*, 20*b*, 20*c* and 20*d* are or can be pushed into the press holes 15. Escape grooves 16 are formed in the bottom surface of the mounting space 14. The escape grooves 16 communicate with the wire arrangement grooves 13*a*, 13*b* and 13*c* and are open in the rear end surface of the connector housing 11.

The blade-type terminal fittings 20*a*, 20*b*, 20*c* and 20*d* are formed e.g. by bending a metal plate and have connection portions 21*a*, 21*b*, 21*c* and 21*d* at the bottom ends thereof, forward projecting male tabs 22*a*, 22*b*, 22*c* and 22*d* at the upper ends thereof, and elongated coupling portions 23 for coupling the connection portions 21*a*, 21*b*, 21*c*, 21*d* and the tabs 22*a*, 22*b*, 22*c*, 22*d*, respectively. Four blade-provided terminal fittings are provided in one joint connector 10. Three of the blade-type terminal fittings (hereinafter, the first to third blade-type terminal fittings) 20*a*, 20*b* and 20*c* are mounted in the connector housing 11 such that the leading ends of the male tabs 22*a*, 22*b* and 22*c* project into the connecting portion 12 by pushing the male tabs 22*a*, 22*b* and 22*c* thereof into the three press holes 15 at the lower side. The remaining blade-type terminal fitting (hereinafter, the fourth blade-type terminal fitting) 20*d* is mounted in the connector housing 11 by pushing the male tab 22*d* thereof into the press hole 15 at the upper side. In the assembled state, the connection portions 21*a*, 21*b* and 21*c* of the first to third terminal fittings 20*a*, 20*b* and 20*c* are located in positions of the wire arrangement grooves 13*a*, 13*b*, 13*c* near the front ends thereof, respectively, and the connection portion 21*d* of the fourth terminal fitting 20*d* is located in the wire arrangement groove 13*a* as that of the first terminal fitting 20*a*, but in a position more backward than the first connection portion 21*a*. The respective connection portions 21*a*, 21*b*, 21*c* and 21*d* have a known construction comprised of a pair of front and rear blades each formed with a downwardly opening slit-shaped cutting edge. When a wire is pushed into the cutting edge, a resin insulation coating is cut by the cutting edge to bring a core of the wire into contact with the blades. The first to third male tabs 22*a*, 22*b* and 22*c* are arranged substantially side by side, and the fourth male tab 22*d* is located above the first male tab 22*a*. It should be noted that the coupling portions 23 move along the escape grooves 16 while the terminal fittings 20*a*, 20*b*, 20*c* and 20*d* are mounted.

A cutter 25 is arranged in the first wire arrangement groove 13*a* where the first and fourth connection portions 21*a*, 21*d* are located. This cutter 25 is formed e.g. by bending a metal piece so as to put both halves substantially together and extends in a direction at an angle different from 0° or 180°, preferably substantially normal to the longitudinal direction of the wire arrangement groove 13*a*. The cutter 25 is also formed with a V-shaped cutting edge 25A opening towards a position of the main wire Waa, preferably downward. Such a cutter 25 preferably is held by pushing a mount end 26 provided at its one side into a partition wall 17 between the adjacent wire arrangement grooves 13*a* and 13*b*.

The wire cover 30 has a shallow tray-like shape having an open upper surface, and is so fitted as to substantially cover the bottom surface of the connector housing 1. The wire cover 30 is locked into the connector housing 11 by engaging projections 18 provided on outer side surfaces of the connector housing 11 with locking holes 31 formed in side walls of the wire cover 30. Pressing portions 32 project on the upper surface of the bottom wall of the wire cover 30 to correspond substantially to the first to fourth connection portions 21*a*, 21*b*, 21*c* and 21*d*. Three pressing portions 32 arranged one after another are provided for each of the connection portions 21*a*, 21*b*, 21*c* and 21*d*. The middle pressing portions 32 are so located as to be fittable between the blades of the respective connection portions 21*a*, 21*b*, 21*c* and 21*d*, and the pressing portions 32 at the opposite sides are located along the outer surfaces of the respective blades. The wire cover 30 is assembled with the connector housing 11 with the main wires Waa, Wab and Wac located on the openings of the cutting edges of the connection portions 21*a*, 21*b*, 21*c*, 21*d*. The pressing portions 32 then push the main wires Waa, Wab and Wac substantially in parallel between the cutting edges. As a result the main wires Waa, Wab and Wac are connected with the connection portions 21*a*, 21*b*, 21*c* and 21*d*. Further, guide portions 33 are formed on the two pressing portions 32 located between the connection portions 21*a* and 21*d*. The guide portions 33 have a bigger projecting height, e.g. project more upward than the upper surfaces of the pressing portions 32, and preferably hold the cutter 25 at the front and rear sides of the cutter 25 when the wire cover 30 is assembled with the connector housing 11. Side surfaces of the guide portions 33 opposite from the cutter 25, i.e. those substantially facing the connection portions 21*a* and 21*d*, are steeply sloped.

Figure 10:
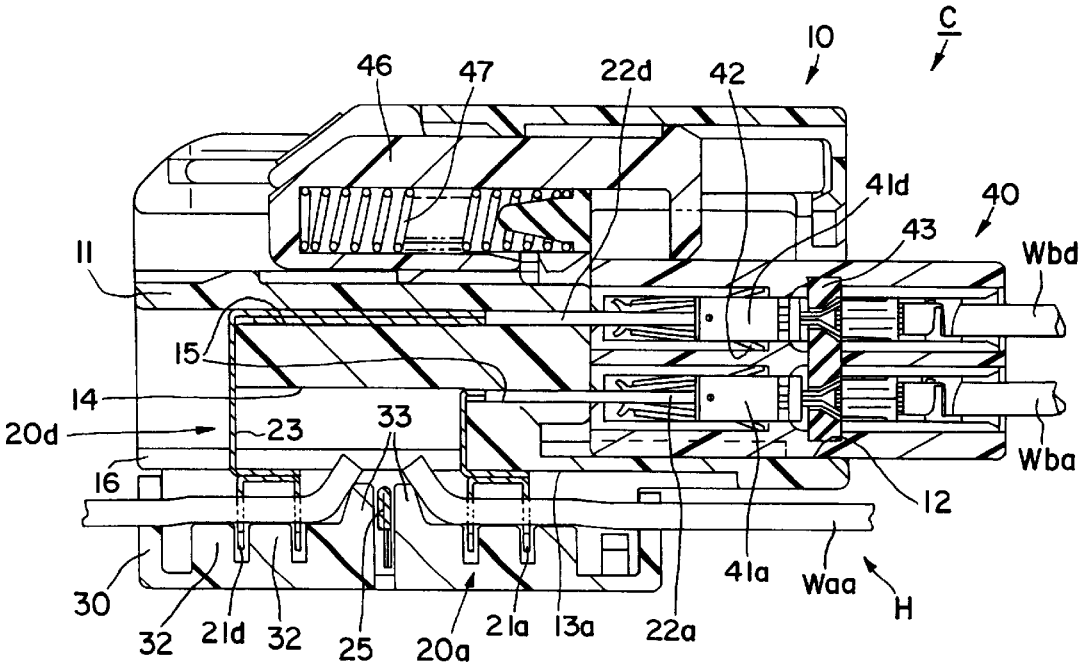
FIG. 10 is a section showing a state where a branching connector is connected with the joint connector.
Figure 11:
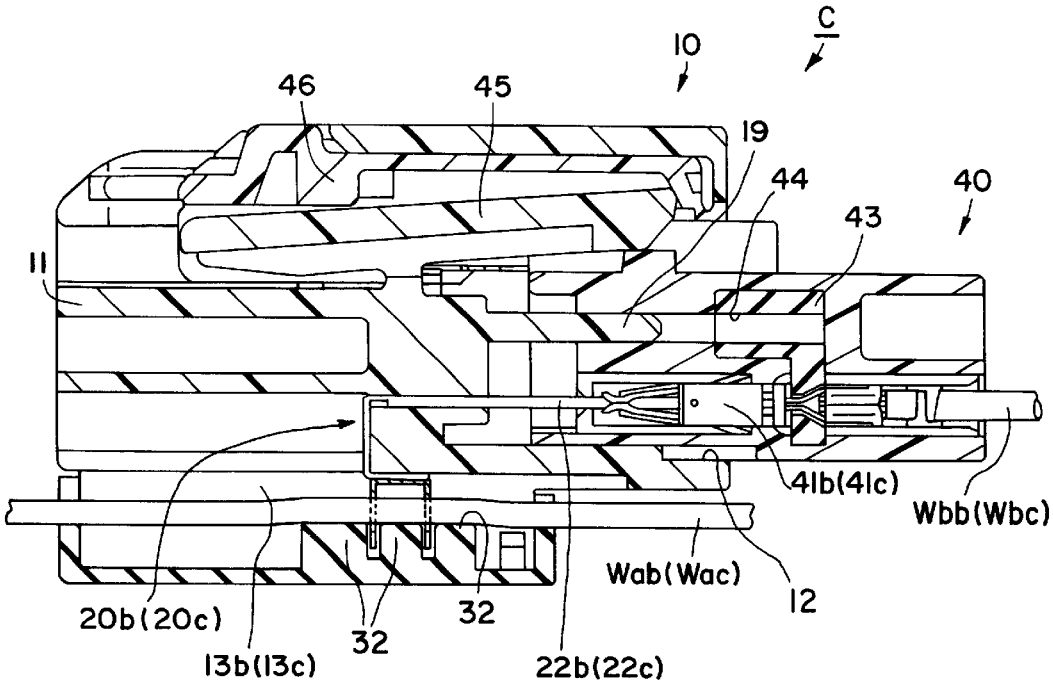
FIG. 11 is a section showing a state during the connection of the branching connector with the joint connector.
Figure 12:
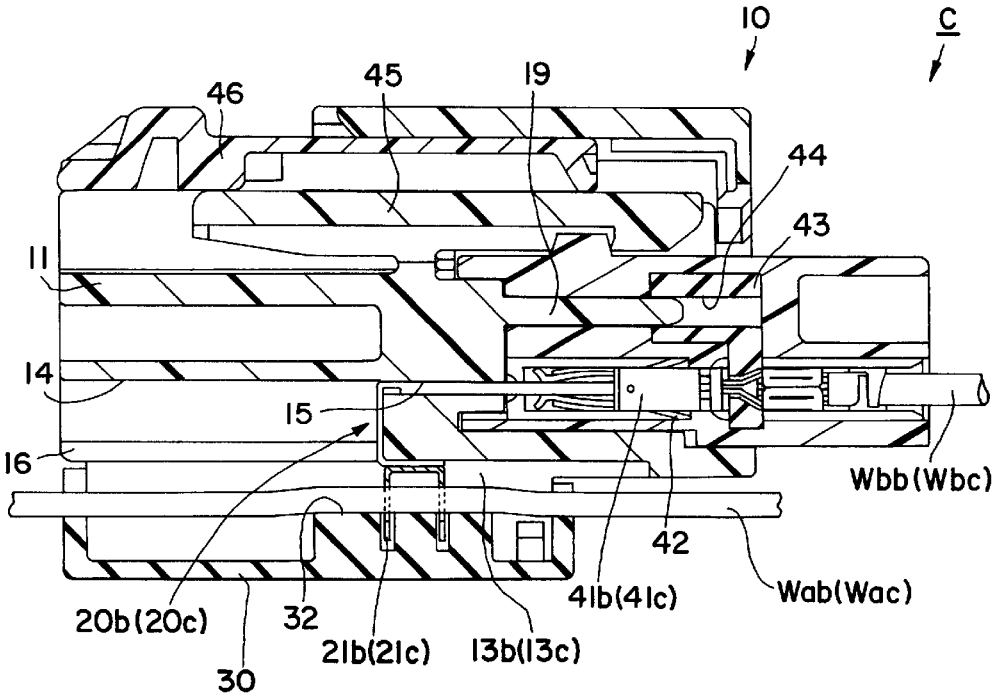
FIG. 12 is a section showing a mechanism for locking the joint connector and branching connector into each other.
Figure 13:
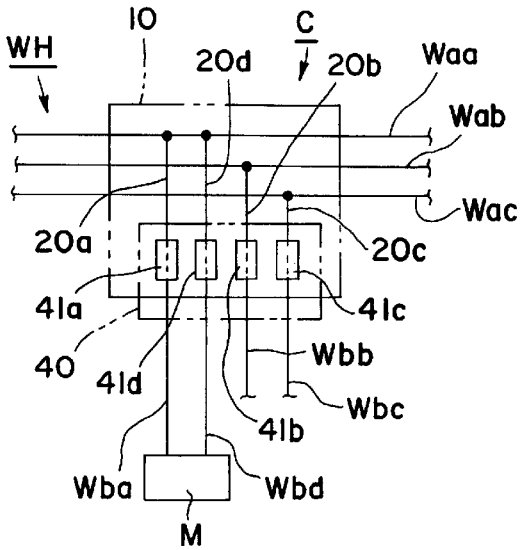
FIG. 13 is a schematic diagram showing an arrangement of the main wires and branch wires.
Figure 14:
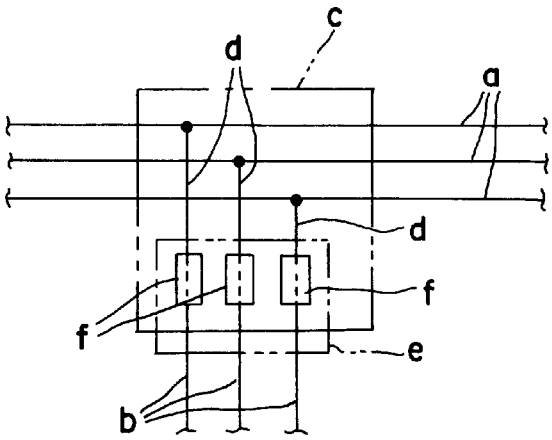
FIG. 14 PRIOR ART
FIG. 14 is a schematic diagram showing a construction for branching branch wires from main wires.
Figure 15:
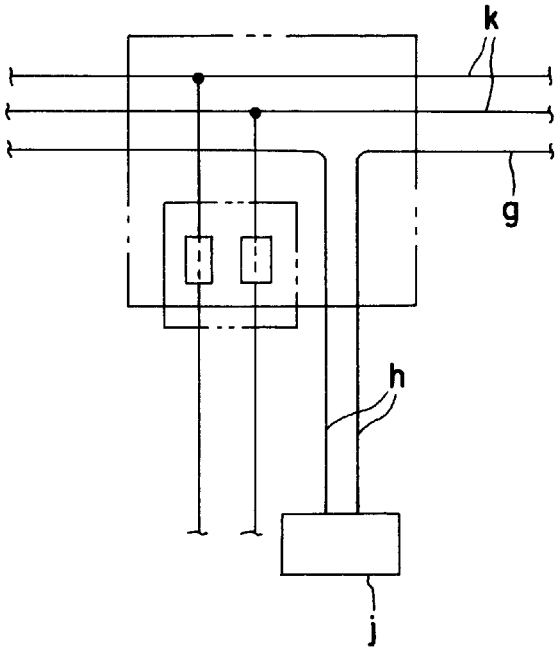
FIG. 15 PRIOR ART
FIG. 15 is a schematic diagram showing a proposed construction for branching the branch wires from the main wire.

The branching connector 40 is constructed to be at least partly fittable or insertable into the connecting portion 12 of the joint connector 10, as shown in FIG. 10. The branching connector 40 accommodates four female branch terminal fittings (first to fourth branch terminal fittings) 41*a*, 41*b*, 41*c* and 41*d* corresponding to the male tabs 22*a*, 22*b*, 22*c* and 22*d* therein. The branch terminal fittings 41*a*, 41*b*, 41*c* and 41*d* are securely doubly locked by locking portions 42 formed therein and by a retainer 43 which preferably is fitted sideways into the branching connector 40. The first to fourth branch wires Wba, Wbb, Wbc and Wbd are or can be connected with the first to fourth branch terminal fittings 41*a*, 41*b*, 41*c* and 41*d* e.g. by crimping. In an area of the branching connector 40 where the branch terminal fittings 41*a*, 41*b*, 41*c* and 41*d* are not provided, there is formed a positioning hole 44 into which a positioning projection 19 of the joint connector 10 is fittable when the joint connector 10 and the branching connector 40 are properly connected.

During the connection of the branching connector 40, a lock arm 45 of the joint connector 10 is deflected elastically (see FIG. 11) and a compression coil spring 47 of a slider 46 provided in the joint connector 10 is elastically compressed (see FIG. 10). When the branching connector 40 is connected properly, the lock arm 45 is restored elastically substantially to its original shape to engage a receiving portion of the branching connector 40, with the result that the branching connector 40 is held locked into the joint connector 10. Further, the slider 46 is slid forwardly by an elastic restoring force of the compression coil spring 47 to restrict the elastic deformation of the lock arm 45 to further secure the locking, preferably by being interposed (FIG. 13) between a portion of the connector housing 10 and the lock arm 45 and holding the lock arm 45 substantially strut.

Further, a dummy member 50 is or can be fitted into the connecting portion 12 of the joint connector 10 (FIG. 9) before the branching connector 10 is fitted thereinto. The dummy member 50 preferably has a shorting terminal fitting 51 for shorting only the first and fourth male tabs 22*a* and 22*d*.

The assembling of the connector C and the connection of the respective wires Waa, Wab, Wac, Wba, Wbb, Wbc and Wbd are performed in the following procedure. First, the connector housing 11 of the joint connector 10 is turned upside down, and the first to third main wires Waa, Wab and Wac are at least partly placed on the opening ends of the cutting edges of the connection portions 21*a*, 21*b*, 21*c* and 21*d* and the V-shaped cutting edge 25A of the cutter 25 in the corresponding first to third wire arrangement grooves 13*a*, 13*b* and 13*c*. Subsequently, the wire cover 30 is placed on the main wires Waa, Wab and Wac and pushed toward the bottom wall of the connector housing 11. Then, the guide portions 33 push the first main wire Waa in positions near the front and rear sides of the cutter 25, thereby starting the cutting of the first main wire Waa. When the wire cover 30 is pushed further, the first main wire Waa is completely cut. In this state, the wire cover 30 is still on the way to be assembled with the connector housing 11, the connection portions 21*a*, 21*b*, 21*c* and 21*d* have not yet started cutting the insulation coatings of the main wires Waa, Wab and Wac. When the wire cover 30 is pushed further (assembled) in this state, the connection portions 21*a*, 21*b*, 21*c* and 21*d* start cutting the insulation coatings of the main wires Waa, Wab, Wac and are connected completely therewith when the wire cover 30 is assembled completely with the connector housing 11. In this way, the assembling of the joint connector 10 is completed. Subsequently, the branching connector 40 is fitted into the connecting portion 12 of the joint connector 10. Then, the first to fourth branch terminal fittings 41*a*, 41*b*, 41*c* and 41*d* and the first to fourth male tabs 22*a*, 22*b*, 22*c* and 22*d* are connected, thereby preferably completing the connection of the wiring harness WH and the connector C.

In this state (FIG. 13), there is constructed one electrically conductive path which extends from a front part of the cut first main wire Waa and returns to a rear part thereof via the first blade-type terminal fitting 20*a*, the first branch terminal fitting 41*a*, the first branch wire Wba, the equipment M, the fourth branch wire Wbd and the fourth blade-type terminal fitting 20*d*. For the second and third main wires Wab and Wac, branch paths extending to the second and third branch wires Wbb, Wbc via the second and third blade-type terminal fittings 20*b*, 20*c*, the second and third branch terminal fittings 41*b* and 41*c* are branched from the second and third main wires Wab and Wac, respectively.

In the case that the branching connector 40 is not fitted immediately after the completion of the assembling of the joint connector 10, the dummy member 50 may be fitted into the connecting portion 12 and detached from the joint connector 10 immediately before the branching connector 40 is fitted.

The connector C according to this embodiment has several significant effects. For example, one possible means for constructing one electrically conductive path which extends from the first main wire Waa and returns again to the first main wire Waa via the first and fourth branch wires Wba and Wbd could include a method for setting the main wire to be extended longer than the other main wires and branching the lengthened portion from the main path of the wiring harness. However, according to this possible method, only the lengthened main wire sticks out of the wire bundle. This complicates a process of producing the wiring harness and causes a problem that the wire sticking out of the wire bundle gets caught while the wiring harness is handled. Contrary to this possible method, if the connector C according to this embodiment enables, all the main wires Waa, Wab, Wac forming the wiring harness WH are allowed to have the same length and to be bundled together. Accordingly, the above problems do not occur in producing and handling the wiring harness WH.

Since the cut ends of the first main wire Waa are bendingly deformed in directions away from each other (are pushed to be spaced wide apart) by the guide portions 33, the shorting of the cut ends can be securely prevented.

The first and fourth blade-type terminal fittings 20*a* and 20*d* can be shorted by the shorting terminal fitting 51 until the branching connector 40 is fitted after the main wires Waa, Wab and Wac are arranged in the joint connector 10. Accordingly, a potential difference between the two blade-type terminal fittings 20*a* and 20*d* when the branching connector 40 is not connected can be prevented.

Since the contact portions of the main wires with the blade-type terminal fittings and the cut portion are covered by the wire cover 30, interference and deposition of external matter can be prevented.

The main wires Waa, Wab, Wac are connected with the corresponding terminal fittings and cut by an operation of assembling the wire cover 30 with the connector housing 11. Thus, as compared with a case where the connection and the cutting are performed as separate operation steps by automatic machines, the number of operation steps can be reduced.

Finally when being cut, the first main wire Waa is unavoidably deformed and curved upon being subjected to a resistance from the cutter 25. In this case, the opposite ends of the curved portion are pulled along the longitudinal direction of the first main wire Waa while the first main wire Waa is being cut, and are returned in opposite directions along the longitudinal direction upon being released from the pulling force after the cutting. In this embodiment, the first main wire Waa is connected with the blade-type terminal fittings at the opposite sides of the cut portion after being cut. Accordingly, there is no likelihood that the first main wire Waa moves back and forth along its longitudinal direction in the connected positions as in a case where it is cut after being connected with the terminal fittings. Therefore, contact stability in the connected positions can be secured.

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

Although the cutter is provided in the connector housing and the guide portions are provided in the wire cover in the foregoing embodiment, the cutter and the guide portions may be provided in the wire cover and the connector housing, respectively. Alternatively, both the cutter and the guide portions may be provided in the connector housing or in the wire cover.

Although the main wire is connected with the terminal fittings after being cut in the foregoing embodiment, the cutting and the connection may be simultaneously performed or the cutting may be performed after the connection if there is provided a means for restricting a longitudinal movement of the main wire during the cutting.

The cutter is provided in the joint connector in the foregoing embodiment. However, the main wire may be cut by an automatic machine instead of providing the cutter in the joint connector.

What is claimed is:

1. A connector for branching at least two branch wires from a cut position of a main wire of a wiring harness to construct one electrically conductive path which extends from one part of the cut main wire and returns to the other part of the cut main wire via the branch wires, the connector comprising:

a joint connector;

at least two blade-type fittings provided in the joint connector for connection with the main wire;

a branching connector connectable with the joint connector;

two branch fittings provided in the branching connector, the branch fittings being secured to the branch wires and being connectable with the blade-type fittings; and a cutter provided between the two blade-type fittings in the joint connector for cutting the main wire.

2. A connector according to claim 1, wherein the joint connector comprises a connector cover having at least one pressing portion provided in at least one position corresponding to respective terminal fittings for connecting the corresponding wires with the terminal fittings.

3. A connector according to claim 1, further comprising a guide portion provided in proximity to the cutter for displacing cut ends of the main wire cut by the cutter in directions substantially away from each other.

4. A connector according to claim 3, wherein a dummy member is provided with a shorting terminal fitting for shorting the two blade-type fittings, the dummy member being at least partly fittable into a connecting portion of the joint connector into which the branching connector is at least partly fittable.

* * * * *